US006823966B1

(12) United States Patent
Henson

(10) Patent No.: US 6,823,966 B1
(45) Date of Patent: Nov. 30, 2004

(54) DESCENDER APPARATUS

(75) Inventor: William E. Henson, Otter Lake, MI (US)

(73) Assignee: American Escape Systems, Inc., Rochester Hills, MI (US)

( * ) Notice: Subject to any disclaimer, the term of this patent is extended or adjusted under 35 U.S.C. 154(b) by 0 days.

(21) Appl. No.: 10/279,616

(22) Filed: Oct. 25, 2002

(51) Int. Cl.[7] ..... A62B 1/20

(52) U.S. Cl. ..... 182/193; 182/7; 182/73; 188/65.2

(58) Field of Search ..... 182/193, 5–7, 182/72, 191, 192, 231, 71, 18; 188/65.2, 65.4, 65.5

(56) References Cited

U.S. PATENT DOCUMENTS

| | | | | | |
|---|---|---|---|---|---|
| 1,296,052 | A | | 3/1919 | Dietz | |
| 2,721,685 | A | | 10/1955 | Frankel | |
| 2,729,425 | A | | 1/1956 | Gschwind | |
| 3,220,511 | A | | 11/1965 | Holkesvick | |
| 3,250,515 | A | | 5/1966 | Hudnall et al. | |
| 3,640,530 | A | * | 2/1972 | Henson et al. | 482/116 |
| 3,779,479 | A | * | 12/1973 | Lindblad | 242/384.6 |
| 3,949,832 | A | | 4/1976 | Hunter | |
| 4,311,217 | A | * | 1/1982 | Wood | 188/65.2 |
| 4,476,956 | A | * | 10/1984 | Eger | 182/5 |
| 4,550,801 | A | | 11/1985 | Forrest | |
| 4,598,793 | A | * | 7/1986 | Lew et al. | 182/42 |
| 4,674,599 | A | | 6/1987 | Nelson | |
| 4,690,381 | A | * | 9/1987 | Asai | 254/394 |
| 5,038,888 | A | | 8/1991 | Varner et al. | |
| 5,145,028 | A | * | 9/1992 | Wai | 182/5 |
| 5,503,345 | A | * | 4/1996 | Kaneko | 242/279 |
| 5,842,542 | A | | 12/1998 | Tien | |
| 6,019,195 | A | * | 2/2000 | Pelofi | 182/192 |

* cited by examiner

*Primary Examiner*—Bruce A. Lev
(74) *Attorney, Agent, or Firm*—Alex Rhodes

(57) ABSTRACT

A descender apparatus for lowering a person in a controlled manner from a height to a relatively lower height and for use as a safety equipment for workers and mountain climbers comprising a generally cylindrical housing; a rope arranged in the housing about a vertical axis of the housing in a stack of layers of closely wound coils and a friction core at one end of the housing for controlling a rate of descent and uncoiling the coils of rope as they are withdrawn from the housing; and a camshaft in transverse relationship to the axis of the housing for selectively controlling the rate of descent during the lowering of the person.

12 Claims, 3 Drawing Sheets

DESCENDER APPARATUS

FIELD OF THE INVENTION

This invention generally relates to escape apparatus and more particularly to an improved descender apparatus for lowering a person from a height to a relatively lower height.

BACKGROUND OF THE INVENTION

Numerous descender apparatus exist in the art for lowering a person from a height to a relatively lower height. They are used for a variety of purposes such as rescuing persons from buildings and as the safety equipment of tree trimmers, window washers, construction workers and mountain climbers. U.S. Pat. No. 3,220,511 is directed to a descender apparatus for lowering men and equipment from low-flying and hovering aircraft.

One type of descender apparatus lowers a person along a safety line or rope which extends from a height to the ground. One characteristic of this type of descender is that a rate of descent is controlled by the friction of a safety line wrapped around a shaft having a smooth outer surface. One disadvantage with this type is that its performance, especially the rate of descent is affected by the weight of the safety line which is below the descender. In the case of a long safety line, weight can be an important factor. Another disadvantage is that during storage the safety line must be protected against damage and being tangled. U.S. Pat. Nos. 3,220,511; 5,038,888; 4,550,801; 3,949,832; and 3,250,515 are exemplary of this type of descender.

In another type of descender apparatus, a person is lowered by withdrawing a line or narrow belt from a reel or spool which is mounted in the descender. The reel is mounted for rotation about a horizontal axis. One disadvantage with this type is that only a limited amount of rope is stored on the reel, thereby limiting the height at which the descender can be used. Another disadvantage is that a rather complicated brake must be incorporated to control the rate of descent of a person. U.S. Pat. Nos. 1,296,052; 2,721,685; 2,729,425; 4,674,599; and 5,842,542 are exemplary of this type of descender apparatus.

SUMMARY OF THE INVENTION

The present invention overcomes all of the shortcomings of the above described descender apparatus. One benefit of the invention is a compact size which provides a high measure of portability and allows a storage of the apparatus in common articles such as desk drawers, suitcases, filing cabinets and vehicle luggage compartments. The compact size also allows a common unit to be used as rescue equipment as well as the safety equipment of tree trimmers, window washers, construction workers and mountain climbers. It can also be used by sailors and passengers when abandoning ships, carried by firefighters when fighting fires, for a high speed deployment of troops and equipment during a battle. Another benefit of the invention is that it is easy to use, requiring little, if any training.

Another feature of the invention is flexibility. A long safety line can be stored in the descender apparatus for lowering persons from great heights. Moreover, the invention provides numerous and novel features at a moderate in cost, thereby making the invention available to the public at large.

Another distinguishing feature is that the safety line is coiled and stacked in layers inside of a housing. This allows for lowering persons from substantial heights. Still yet another distinguishing feature is a friction core which uncoils the safety line as it is withdrawn from the descender. The friction core is the key which makes it possible to stack a quantity of layers in a housing.

Still yet another benefit is the storage in a minimum of space in suitcases, desks, vehicle luggage compartments, cabinets and chest drawers. The compact arrangement allows the descender apparatus to be carried on a person, such as a fireman or mountain climber, or to be stored at a fixed location for further use. Still yet another benefit is a novel means for adjusting a rate of descent of a person.

The present invention is comprised of a generally cylindrically shaped housing; a lifeline which is coiled and stacked in layers inside of the housing; a friction core at an exit end of the housing for uncoiling the lifeline as it is withdrawn from the housing; a means for controlling a rate of descent of a person and a means for attaching one end of the lifeline to a fixed structure such as building.

In employing the teaching of the present invention, a plurality of alternate constructions can be adopted to achieve the desired results and capabilities. In this disclosure, one embodiment is discussed. However, the disclosed embodiment is intended as an example only and should not be considered as limiting the scope of the invention.

Further features and benefits will be apparent by reference to the drawings and ensuing detailed description of a preferred embodiment which discloses the best mode contemplated in carrying out the invention. The exclusive rights which are claimed are set forth in the numbered claims following the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating a preferred embodiment of the invention by way of non-limiting example only.

DETAILED DESCRIPTION OF A PREFERRED EMBODIMENT

Figure 2:
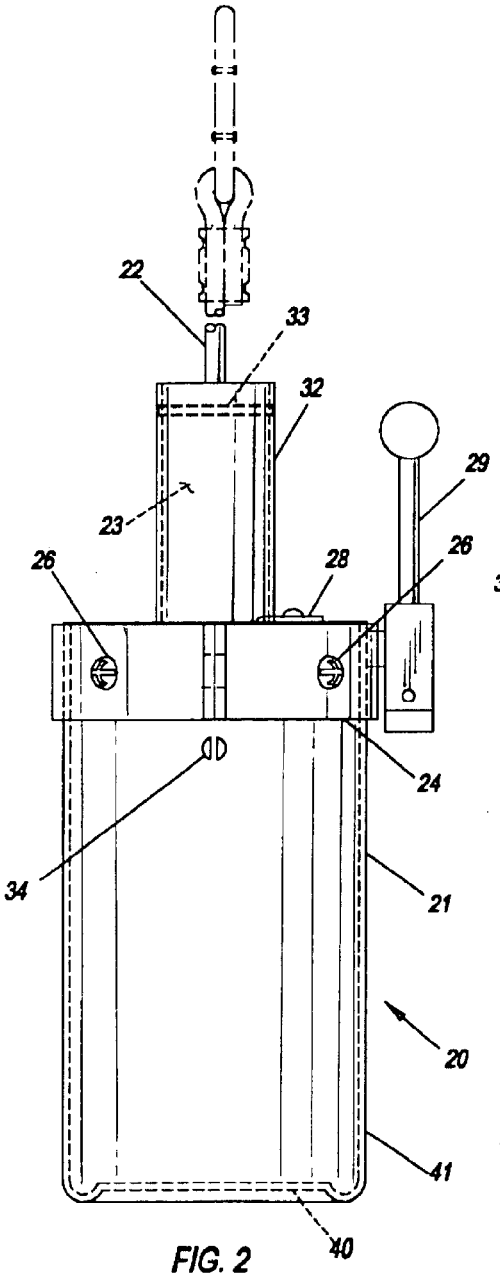
FIG. 2 is a front elevation view of the descender apparatus.
Figure 1:
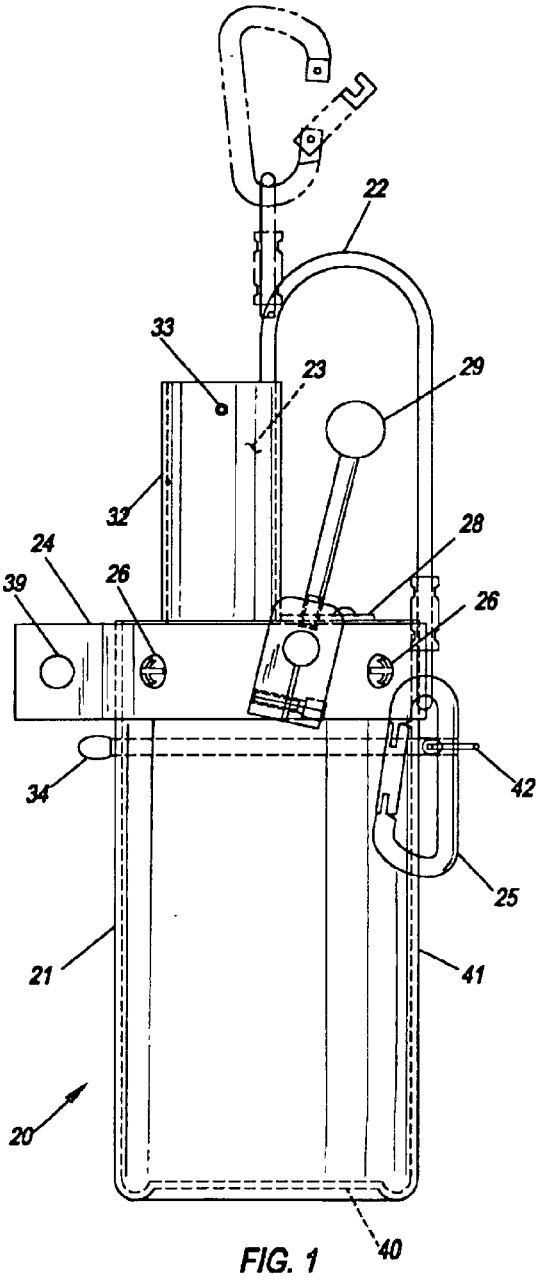
FIG. 1 is a right side view of a descender apparatus according to the present invention.

Referring now to the drawings wherein like numerals designate like and corresponding parts throughout the several views, a preferred embodiment of a descender apparatus 20 is shown according to the invention. The descender apparatus 20 is used for a controlled lowering of a person from a height to a relatively lower height during an emergency, such as an earthquake or fire. As previously indicated, it may also be used as an article of safety equipment of tree trimmers, window washers, construction workers, travelers and mountain climbers.

The descender apparatus 20 is generally comprised of a housing 21, a life line or rope 22 coiled and stacked in layers inside of the housing 21, a friction core 23 at an exit end of the housing 21 for uncoiling the rope 22 as it is withdrawn from the housing 21 and for controlling a rate of descent; a carabiner 25 or other means for attaching the rope 22 to a fixed structure such as a building (not shown); and a means 24 for attaching the descender apparatus 20 to a person (not shown). A slender cylindrical retainer 34 extends through the housing 21. The operative position of the carabiner 25 is shown in phantom and the stored position is shown in continuous line. The purpose of the retainer 34 is to prevent an inadvertent withdrawal of the rope 22 before an emergency occurs. The carabiner 25 is attached with a thin wire 42 to an end portion of the retainer 34 to insure that the retainer 34 will be withdrawn when the descender 20 is placed in service.

Figure 4:
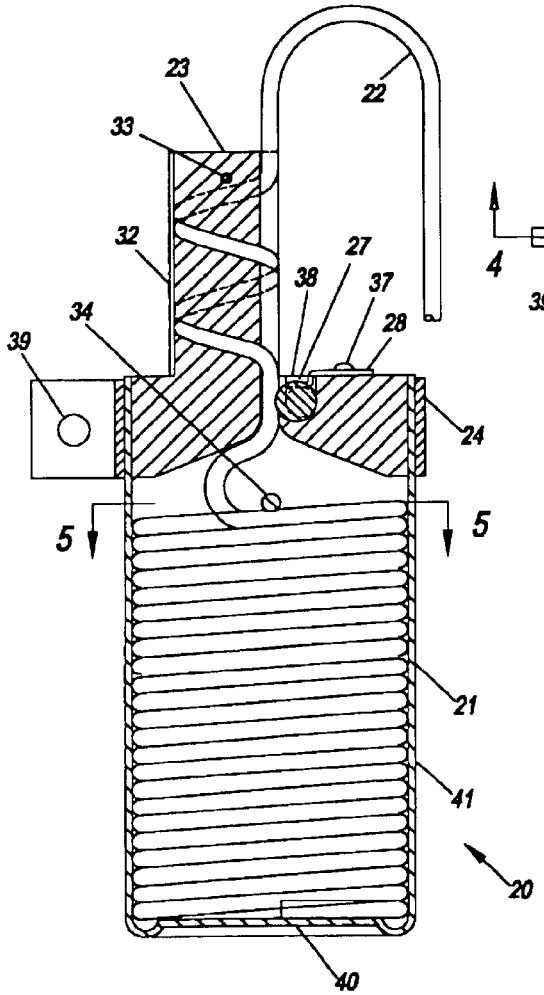
FIG. 4 is a longitudinal sectional view of the descender apparatus taken on the line 44 in FIG. 3 showing the internal construction of the descender apparatus.
Figure 3:
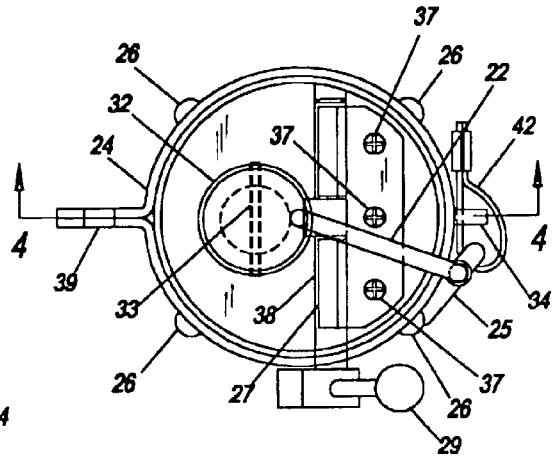
FIG. 3 is a plan view of the descender apparatus.
Figure 5:
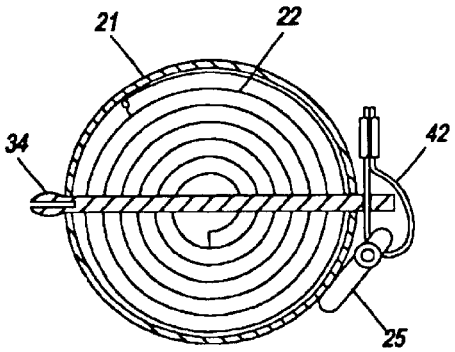
FIG. 5 is a cross-sectional view taken on the line 5—5 in FIG. 4 showing the manner in which a safety line is coiled in stacked layers and a retainer for preventing an inadvertent withdrawal of the safety line.
Figure 6:
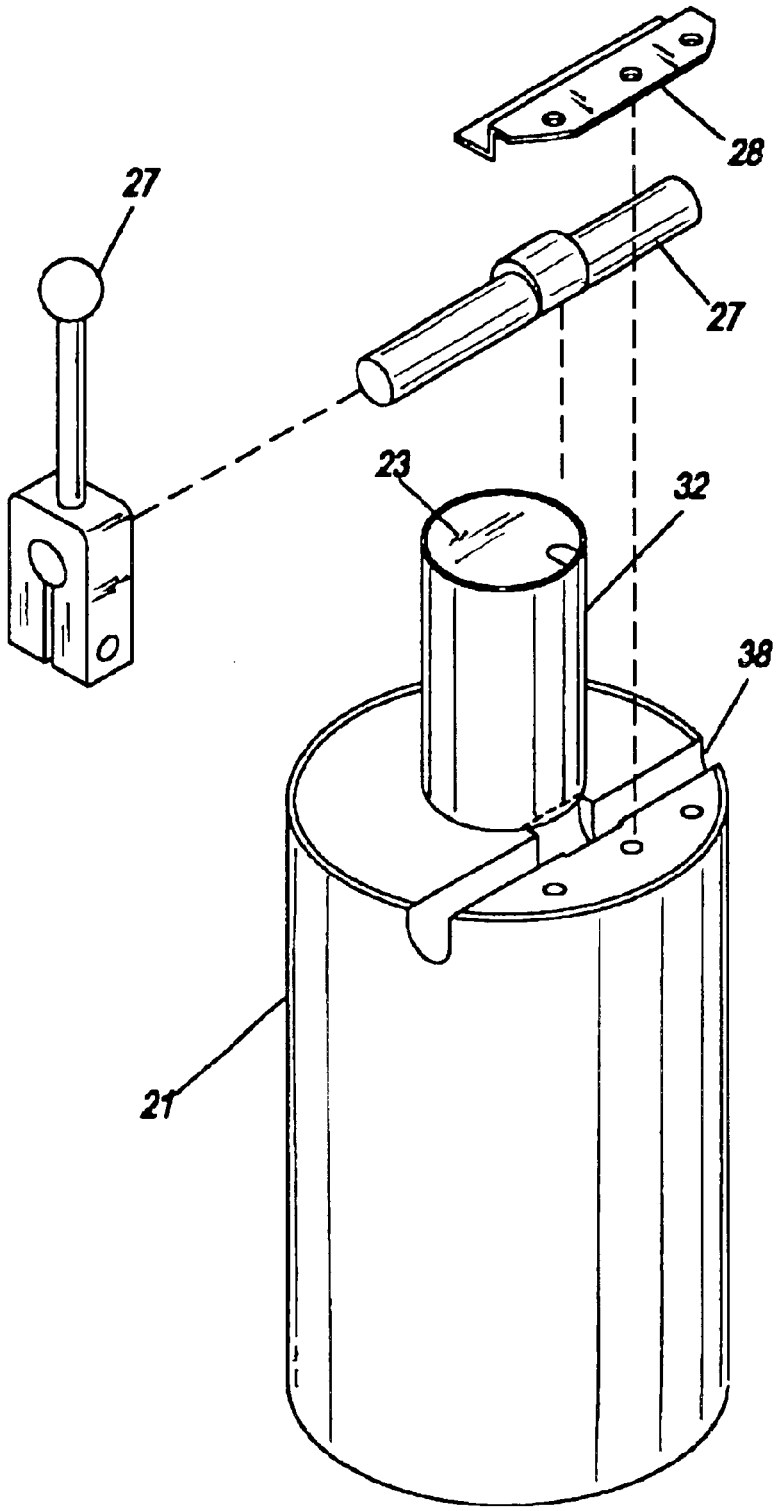
FIG. 6 is an exploded view in perspective of a portion of the safety apparatus.

Referring specifically to FIG. 4, the housing 21 which is depicted in the drawings is a generally cylindrical structure having a circular bottom wall 40 and a thin cylindrical side wall 41. The top portion of the housing 21 is open and receives the friction core 23. A stamped bracket 24 with an aperture 39 is suitably welded or joined by another well known means to the housing's side wall 41 for receiving a carabiner (not shown) or other fastener which is attached to the restraint device such as a safety belt or harness (not shown). Inside of the housing 21 are stacked layers of the safety rope 22. In the preferred embodiment described herein, a 0.25 diameter rope 22 is used, it being understood that larger or smaller diameter ropes can be used. The rope is made of a multi-strand material such as Kevlar® or Nylon®, i.e. materials which are extensively used in the art of safety lines. The 0.25 inch diameter line provides a high safety factor for supporting an individual. The direction of coiling the rope 22 is an important parameter of the invention. The direction can be either clockwise or counterclockwise, so long as it is coordinated with the direction of a helical groove on the friction core 23, the rule of the invention being that the directions of the coiling of the rope 22 and helical groove must be opposite. By way of example, if the rope 22 is coiled clockwise (i.e. right hand coiling) the helical groove 35 of the friction core 23 must turn counter-clockwise (i.e. a left hand helix).

Prototype assemblies were fabricated and tested with a 0.25 inch rope 22 to validate the effectiveness of the invention. The test results were excellent. Table 1 and Table 2 were developed in conjunction with the design, building and testing of the prototypes. It should be understood that other embodiments are possible with such obvious changes as changes in the diameter of the rope 22, inside diameter of the inner coils, dimensions of the housing 21 and the length of the rope 22.

Tables 1 and 2 are based on an inner coil having an inside diameter of 0.875 inches. Housing diameters, rope lengths and coil dimensions are shown for descents from a building of 26 stories and below. Theoretical and actual lengths of rope lengths per layer and the average numbers of coils per layer are shown for several alternate housings, all having 0.06 inch thick walls. What is meant by the term theoretical values herein are values for layers which lie entirely in a plane as opposed to the actual values which include a small additional length for the transition of the end of an outer coil of a next higher layer.

TABLE 1

| Bldg Stories | Housing O.D. | Rope Length | # Layers | Stack Height |
|---|---|---|---|---|
| 3 and Below | 3 Inches | 40 Feet | 29.37 | 5.09 Inches |
| 7 and Below | 3½ Inches | 80 Feet | 28.76 | 7.16 Inches |
| 12 and Below | 4 inches | 130 Feet | 34.84 | 8.71 Inches |
| 25 and Below | 5 Inches | 260 Feet | 43.18 | 10.79 inches |

TABLE 2

| Housing Outside Diameter | Coils per Layer | Rope Length per Layer (Theo) | Rope Length per Layer (Actual) | Ave. Coil Length per Layer (Theo.) | Ave. Coil Length per Layer (Actual) |
|---|---|---|---|---|---|
| 5 Inches | 8 | 72.3 Inches | 74.3 Inches | 9.03 Inches | 9.28 Inches |
| 4½ Inches | 7 | 57.7 Inches | 59.5 Inches | 8.25 Inches | 8.50 Inches |
| 4 Inches | 6 | 44.8 Inches | 46.3 Inches | 7.46 Inches | 7.71 Inches |
| 3½ Inches | 5 | 33.4 Inches | 34.6 Inches | 6.68 Inches | 6.93 Inches |
| 3 Inches | 4 | 23.6 Inches | 24.6 Inches | 5.89 Inches | 8.14 Inches |

By way of example for using Tables 1 and 2, assume that a descender apparatus is needed for a maximum descent of 12 stories (i.e. 130 feet or less). From Table 1, a cylindrical housing having a 4.00 inch outer diameter is specified having 38.84 layers consisting of 130 feet of 0.25 inch diameter rope 22. The overall height (stack height) of the layers is 8.71 inches. From Table 2 we see that the actual length of rope 22 in each layer is 34.6 Inches and the actual average length of rope in each layer (i.e. actual length divided by number of coils) is 6.93 inches. We also observe from Table 1 that the invention provides for 260 feet of 0.25 inch diameter rope in a 5.00 Inch diameter housing for a descent of 25 stories or less.

This storage of this incredible amount of rope 22 is feasible because of the friction core 23 at the end of the housing 21. Without the friction core 23, the rope 22 would become hopelessly tangled inside of the housing 21. Referring now to FIG. 4, the friction core 23 is a cylindrical member with a groove 35 on an outer portion of the friction core 23. It is connected to the housing with threaded fasteners 26 which extend through apertures in the side wall 41 of the housing 21. It is to be noted that the center of the friction core 23 is offset from the center of the housing 21 such that the rope 22 is withdrawn through an aperture which is aligned with the center of the housing 21. The rope 22 enters the groove 35 and extends a small distance vertically into a helical portion of the groove 35 which turns in an opposite direction of the coils inside of the housing 21 and thence vertically by a small amount through an exit of the friction core 23.

The rope 22 is retained in the friction core 23 by a thin sleeve 32 and a roll pin 33. A carabiner 25 is attached to the end of the rope 22 for connecting the descender apparatus 20 to a safety belt or safety harness (not shown). It is advisable to provide generous radii at the beginning and end of the helical groove 35 to prevent damage to the rope 22 and for smooth operation.

A second rule of the invention is that the length of the helical portion of the groove 35 of the friction core 23 is equal to the average length of the rope 22 in one of the layers. This relationship removes the twist in each layer of rope 22 as the rope 22 is withdrawn from the housing. The length of the helical portion of the groove 35 can be adjusted for differences in the average length of coil per layer by varying the helix angle of the helical portion of the groove 35. The helical portion of the groove 35 also controls the rate of descent by imposing a drag or friction on the rope 22 as it is withdrawn from the housing 21.

Referring particularly to FIG. 7, a novel means is provided for allowing a person to slow or stop his descent. The novel means is comprised of a camshaft 27 which is rotatably mounted in a slot 38 which extends laterally across a top portion of the friction core 23. The camshaft 27 is retained in the friction core 23 by threaded fasteners 37 and a stamped retainer 28, as shown in FIG. 7. At one end of the camshaft 27 is a handle 29. When the handle 29 is rotated, the camshaft 27 presses against the rope in increasing amounts to slow or stop a descent.

From the foregoing, it will be apparent that my invention provides an affordable descender apparatus having numerous advantages and benefits over the prior art. It is easy to use, requiring little, if any prior training. Moreover, my invention is portable, easy to store and can be used for rescuing people as well as for safety equipment.

Although only a single embodiment has been illustrated and described, it will be appreciated that other embodiments can be derived by obvious changes to persons skilled in the art, such as changes in shape, substitution of parts, re-arrangements of parts, inversions of parts and elimination of parts without departing from the scope of the claims which are appended hereto.

What I claim is new is:

1. A descender apparatus for lowering a person from an elevated position to a relatively lower position, comprising: a housing, said housing defining a vertical axis; a rope stored in said housing, said rope arranged about said axis in a stack of layers of closely wound coils; and a friction core, said friction core at one end of said housing having a helical groove for receiving a portion of said rope, said helical groove circling around said friction core in a direction which is opposite to a direction in which said coils circle around said axis of said housing; and a means for uncoiling said rope as said rope is withdrawn from said housing.

2. The descender apparatus recited in claim 1 further comprising a user operating means in said descender apparatus for changing a rate of descent of said person being lowered with said apparatus.

3. The descender apparatus recited in claim 2 wherein said user operating means in said descender apparatus for changing said rate of descent comprises a camshaft rotatably mounted in said apparatus in transverse relationship to said axis of said housing for compressing a portion of said rope.

4. The descender apparatus recited in claim 1 wherein said helical groove has a length which is about equal to an average length of a coil in one of said layers.

5. The descender apparatus recited in claim 1 wherein said housing has a relatively thin cylindrical side wall and an outer diameter within a range of 3 to 5 inches, said rope has an outer diameter of about 0.25 inches and said stack of said layers of coils is within a range of 20 to 43 layers of coils.

6. A descender apparatus for a lowering of a person from an elevated position to a relatively lower position, comprising: a housing, a rope coiled and stored in said housing, said rope having a length which is sufficient for lowering said person from a 25 story building; and a cylindrical friction core at one end of said housing, said friction core having a helical groove extending around an axis of said friction core in an opposite direction to a direction of coils of said rope in said housing for preventing twist in said rope as said rope is withdrawn from said housing.

7. The descender apparatus recited in claim 6 further comprising a means for adjusting a rate of descent during said lowering of said person from said elevated position.

8. A descender apparatus for lowering a person in a controlled manner from an elevated position to a relatively lower position, comprising: a housing; a rope stored in said housing, said rope arranged about a vertical axis of said housing in a stack of layers of closely wound coils, said coils circling about said axis of said housing; and a friction core for uncoiling said rope and controlling a rate of descent of a person connected to said descender apparatus, said friction core comprising a cylindrical body having an axis which is offset from said axis of said housing and having a groove on an outer portion of said body for receiving a portion of said rope, said groove having a helical portion which circles around an axis of said cylindrical friction core body in a direction which is opposite to a direction in which said coils circle around said axis of said housing, said helical portion having a length which is about equal to an average length of a coil in one of said layers in said housing.

9. The descender apparatus recited in claim 8 further comprising a means for selectively adjusting said rate of descent of said person connected to said descender apparatus.

10. A descender apparatus for lowering a person in a controlled manner from an elevated position to a relatively lower position, comprising: a housing; a rope stored in said housing, said rope arranged about a vertical axis of said housing in a stack of layers of closely wound coils: a helical groove in said descender apparatus extending around said axis in an opposite direction to said closely wound coils for receiving and preventing twist in said rope as said rope is withdrawn from said apparatus; and a means for selectively adjusting a rate of descent of a person being lowered by said descender apparatus.

11. A descender apparatus for lowering a person in a controlled manner from a height to a relatively lower height and for use as a safety equipment of workers and mountain climbers comprising: a generally cylindrical housing; a rope arranged in the housing about a vertical axis of the housing in a stack of layers of closely wound coils; and a friction core at one end of said housing having helical grooves circling around said core in a direction which is opposite to the direction of said coils in said housing for controlling a rate of descent and preventing twist in said rope as said coils are withdrawn from said housing; and a camshaft in transverse relationship to said vertical axis of said housing for selectively controlling said rate of descent during a lowering of said person.

12. A method for lowering a person in a controlled manner from a height to a relatively lower height, said method comprising the steps of withdrawing a rope from a descender apparatus which is arranged in a stack of layers of coils in an interior of said housing; withdrawing each of said layers of coils in a direction which is opposite to the direction of said coils in said housing; and selectively adjusting a rate of decent by rotating a camshaft to compress a portion of said rope during said withdrawal of said rope from said housing.

* * * * *